US006901629B2

(12) United States Patent
Wurdack

(10) Patent No.: US 6,901,629 B2
(45) Date of Patent: Jun. 7, 2005

(54) HEAVY DUTY MOLDED EQUIPMENT SLIDE

(76) Inventor: Roy A. Wurdack, 8506 Snow Hill Rd., Ooltewah, TN (US) 37363

( * ) Notice: Subject to any disclaimer, the term of this patent is extended or adjusted under 35 U.S.C. 154(b) by 32 days.

(21) Appl. No.: 10/641,741

(22) Filed: Aug. 15, 2003

(65) Prior Publication Data

US 2005/0034268 A1 Feb. 17, 2005

(51) Int. Cl.[7] ..... A47B 91/06
(52) U.S. Cl. ..... 16/42 R; 248/188.9
(58) Field of Search ..... 16/42 R, 42 T; 248/188.9, 346.11; 280/845, 19, 19.1, 28.17; 384/276, 286, 293, 295

(56) References Cited

U.S. PATENT DOCUMENTS

| | | | | | |
|---|---|---|---|---|---|
| 3,326,508 | A | * | 6/1967 | Born | 248/346.11 |
| 3,909,087 | A | * | 9/1975 | Cairns | 384/293 |
| 4,054,964 | A | * | 10/1977 | Kaneko | 16/20 |
| 4,124,917 | A | * | 11/1978 | Gilliland | 16/42 R |
| 4,575,429 | A | * | 3/1986 | Jacobson | 428/550 |
| 4,695,602 | A | | 9/1987 | Crosby et al. | 524/439 |
| 5,081,740 | A | * | 1/1992 | Smith | 16/42 R |
| 5,216,079 | A | | 6/1993 | Crosby et al. | 525/146 |
| 5,220,705 | A | * | 6/1993 | Bushey | 16/42 R |
| 5,310,156 | A | * | 5/1994 | Matsumura et al. | 248/615 |
| 5,426,818 | A | * | 6/1995 | Bushey | 16/42 R |
| 5,469,599 | A | | 11/1995 | Wurdack | 16/42 R |
| 5,557,824 | A | * | 9/1996 | Bushey | 16/42 R |
| 5,568,671 | A | * | 10/1996 | Harris et al. | 16/18 R |
| 5,782,444 | A | * | 7/1998 | Anderman et al. | 248/188.8 |
| 5,802,669 | A | | 9/1998 | Wurdack | 16/42 R |
| D400,780 | S | | 11/1998 | Wurdack | D8/374 |
| 6,206,424 | B1 | | 3/2001 | Edwards et al. | 280/845 |
| 6,405,982 | B2 | | 6/2002 | Ferencz | 248/188.9 |
| 6,464,256 | B1 | | 10/2002 | Edwards | 280/845 |
| D475,495 | S | | 6/2003 | Edwards | D34/28 |
| D475,496 | S | | 6/2003 | Edwards | D34/28 |
| D475,830 | S | | 6/2003 | Edwards | D34/28 |

FOREIGN PATENT DOCUMENTS

| | | | | | |
|---|---|---|---|---|---|
| DE | 1246960 | B | * | 8/1967 | |
| EP | 733323 | A1 | * | 9/1996 | A47B 91/06 |
| FR | 2436586 | A | * | 5/1980 | A47B 91/06 |
| JP | 63122407 | A | * | 5/1988 | A47B 91/06 |

* cited by examiner

*Primary Examiner*—Chuck Y. Mah
(74) *Attorney, Agent, or Firm*—Grace J. Fishel

(57) ABSTRACT

A slide formed from an upwardly cupped plate made of an acetal copolymer matrix into which a lubricant is incorporated with slidability and load baring capability making it suitable for use in moving furniture or other heavy objects across a floor. A non-slip pad formed of a synthetic plastic material is seated in a recess formed in an upper face of the plate. The plate is shaped such that when it is partially inserted under a heavy object, a forward edge of a lower face of the plate rises above the floor such that the slide will pass over obstacles.

10 Claims, 1 Drawing Sheet

HEAVY DUTY MOLDED EQUIPMENT SLIDE

BACKGROUND OF THE INVENTION

1. Field of the Invention

The present invention relates to a molded slide having a slidability and load bearing capability making it suitable for use in moving furniture or other heavy objects across a floor.

2. Brief Description of the Prior Art

It is often necessary to move office furniture, such as desks, bookcases, partitions and filing cabinets, about an office. The need to move the furniture may arise from a desire to reconfigure the office space or to perform maintenance, such as carpet cleaning or carpet removal and replacement. For example, modular carpet is designed to be installed in occupied office areas with furniture and equipment in place. During installation, furniture and equipment are moved a short distance or lifted while the old flooring is removed and squares of new modular carpet installed. The office furniture or equipment is then slid or lowered into place, permitting installation of new carpet without breaking down work stations, disrupting telecommunication or computer hookups and avoiding business interruptions.

With the exception of moving furniture up and down stairways, it has been found that placing a slide under the object and sliding the furniture or equipment is preferred over using a hand truck or some other device for lifting the furniture. In U.S. Pat. No. 5,469,599 to Wurdack, ultra high molecular weight polyethylene was identified as being suitable for use as a slide for moving furniture when provided as a flat plate having a thickness between about 0.05 inches and 0.15 inches and having a diameter from about 4 inches to 10 inches. The disks were cut from sheets of ultra high molecular weight polyethylene which are formed industrially by skiving large blocks of the plastic. A non-slip pad of synthetic plastic material was then glued to the top surface of the disk.

In U.S. Pat. No. 5,802,669 to Wurdack, polyoxymethylene, an acetal homopolymer, was identified as being suitable for use as a slide for moving furniture when provided as a molded plate with an upturned edge forming a recess into which a non-slip pad could be glued. This was an improvement over the '599 patent, inter alia, in that ultra high molecular weight polyethylene cannot be molded and machining a recess into the top surface was cost prohibitive. The plate in the '669 patent had a thickness between about 0.05 inches and 0.15 inches and had a diameter between about 4 and 10 inches. The homopolymer had a coefficient of friction of about 0.3 and a pressure versus velocity of about 750 or better. The coefficient of friction is a measure of how well the plate slid and the pressure versus velocity number is an indication of how well the plate stood up under loading conditions. The slidability and load bearing capabilities of the '669 slide were better than the '599 slide. However, the recess in the plate was shallow and the non-slip pad was made out of foamed ethylvinylacetate or latex rubber and was stiff. In use, the legs or base of the object being moved tended to slip off the slide and break the rim off the plate.

The load bearing demands on a slide can be extreme as some office furniture and equipment is very heavy (e.g., lateral files weighing over 2,000 pounds) calling for a slide with better load bearing capability. Slidability demands can also be extreme for example when the furniture and other equipment must be slid over a concrete floor. Hence, there remains room for improvement to meet the full range of moving conditions in addition to tackling the slipping-off the slide problem.

BRIEF SUMMARY OF THE INVENTION

In view of the above, it is an object of the present invention to provide a slide having slidability and load bearing capability for use in moving heavy office furniture and equipment. It is another object to provide a slide configured such that the floor contacting portion of an object placed on the slide does not tend to come off the slide. Other objects and features of the invention will be in part apparent and in part pointed out hereinafter.

In accordance with the invention, a slide for use in moving heavy pieces of furniture or other heavy objects across a floor has an upwardly cupped plate formed of an acetal copolymer matrix into which a lubricant is incorporated and has a coefficient of friction of less than 0.2. A non-slip pad formed of synthetic plastic material is seated in a recess provided in an upper face of the plate. The slide has an upstanding rim about a periphery of the recess and a lower face of the plate rises above the floor when the slide is partially inserted beneath a floor contacting portion of the furniture or object.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
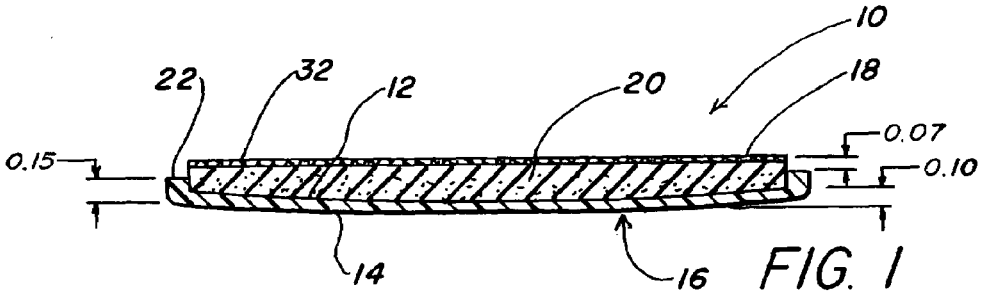
FIG. 1 is a cross-section taken along the plane of 1—1 in FIG. 2 of a slide for moving heavy objects in accordance with the present invention.
Figure 2:
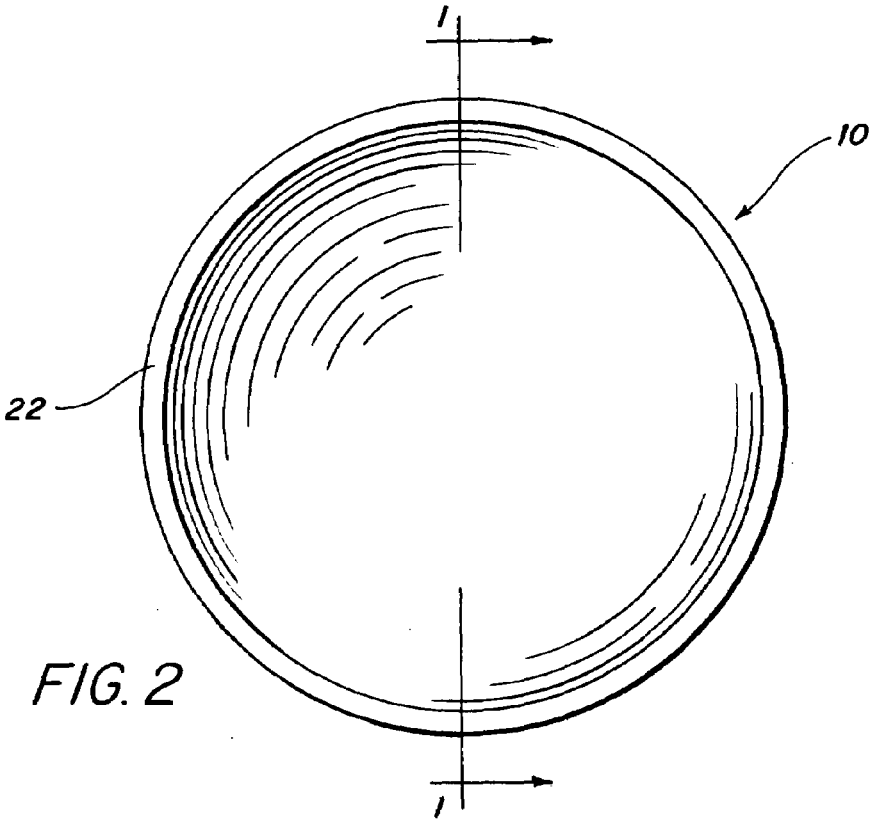
FIG. 2 is a plan view of the slide.

Referring to the drawings more particularly by reference character, reference numeral 10 refers to a slide for moving furniture and other heavy objects across a floor 11. Slide 10 is molded from an acetal copolymer matrix into which a lubricant is incorporated. The slide has a coefficient of friction of less than 0.2. As shown in FIGS. 1–2, slide 10 has an upper and lower face 12, 14, respectively and is molded as an upwardly cupped plate 16 with a recess 18 in upper face 12 for receipt of a non-slip resilient pad 20. An upstanding rim 22 is formed around recess 18 and plate 16 is sufficiently cupped that it can be spun on a surface. Plate 16 has adequate compressive strength that it does not flatten along its forward edge 24 when partially inserted beneath a floor contacting portion 26 of a heavy object 28 as shown in FIG. 3.

Slide 10 is about 3 to 10 inches in diameter, preferably about 5 to 8 inches and most preferably about 6 inches. Plate 16 has a thickness between about 0.05 and 0.15 inches, preferably about 0.08 and 0.12 inches and most preferably about 0.09 inches. Rim 22 is about 0.10 to 0.35 inches high, preferably about 0.12 to 0.30 inches and most preferably about 0.25 inches. Recess 18 is about 0.06 to 0.25 inches deep, preferably about 0.08 to 0.20 inches and most preferably about 0.15 inches. Lower face 14 of plate 16 is elevated above floor 11 between about 0.05 and 0.15 inches, preferably between about 0.8 and 0.12 inches and most preferably about 0.10 inches. As shown in FIG. 2, slide 10 has an outside diameter of 6.00 inches and recess 18 has an outside diameter of 5.60 inches. Slide 10 as compared to the slide described in the '699 patent is stronger and heavier (e.g., a five-inch slide from the '699 patent formed of oxymethylene homopolymer weighs 38 grams whereas a six-inch slide formed of a lubricated oxymethylene copolymer in accordance with the present invention weighs 70 grams).

Figure 3:
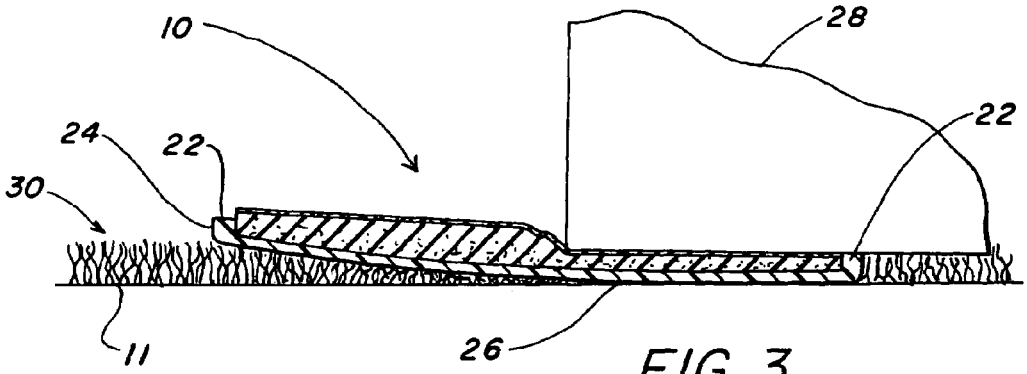
FIG. 3 is a cross-section similar to FIG. 1 but showing the slide partially inserted under a floor contacting portion of the heavy object to be moved.

When rim 22 of slide 10 is pressed down as shown in FIG. 3 under the weight of a heavy load, lower face 14 at forward edge 24 of plate 16 is off floor 11 between about 0.50 and 1.50 inches, preferably about 0.75 and 1.25 inches and most preferably about 1.00 inch. This makes it easier for slide 10 to cam over a carpet 30 as shown in FIG. 3 or some other obstruction such as a threshold. For comparison, a slide as described in the '699 patent tends to flatten under a heavy load and instead of rising above the floor along its forward edge, it may conform to the floor such that the forward edge stubs into the carpet or floor irregularities, making it more difficult to slide the object. The forward edge of the slides in the '699 patent sometimes chips, making sliding of the damaged slide even more difficult and the slide unsuitable to be used again.

Acetal copolymers are well known in the art. Such copolymers are characterized as having recurring oxymethylene groups, i.e., —$CH_2O$—, interspersed with oxy(higher) alkylene groups, e.g., —$CH_2CH_2O$—. Acetal copolymers have better impact strength and coefficient of friction than oxymethylene homopolymers from which the slides in the '699 patent were formed. The addition of a lubricant to the acetal copolymer matrix further improves the impact strength and coefficient of friction of slide 10.

Acetal copolymers can be internally lubricated with polytetrafluoroethylene (PTFE) resins. PTFE may be added to a larger quantity of molten acetal copolymer. Slide 10 molded from such a mixture has better wear resistance and there is a reduction in friction. The mechanism for these improvements may be the formation of a dry film of PTFE between slide 10 and floor surface 11. This film may be formed during the break-in period for the slide, as randomly dispersed particles of PTFE are sheared to form a film on the bearing surface of lower face 14. From 1 to 30 weight percent of PTFE may be added to the acetal copolymer. Lesser amounts (e.g., about 2 weight percent) may be preferred because of cost and other considerations.

An oxymethylene copolymer lubricated with PTFE is commercially available from Ticona, a business of Celanese AG, under the designation CELCON LW90F2. This resin is a CELCON M90 based acetal copolymer formulated with 2 weight percent PTFE. It has excellent wear properties and a static coefficient of friction against steel of 0.12 as measured by ASTM D1894. This compares very favorably against DELRIN 500 which is an oxymethylene homopolymer which has a coefficient of friction of about 0.3.

Other lubricants and lubricant systems for acetal copolymers may be used. For example, a polyolefin or a blend of polyolefin and PTFE have been found useful as a lubricant or lubricant system in acetal copolymers. Suitable polyolefins include polyethylene, polypropylene and polyolefin copolymers, such as ethylene-propylene copolymer, etc. Since polyolefins are less expensive than PTFE, it may be desirable to replace as much of PTFE as possible with polyolefin. As reported in Example 3 of U.S. Pat. No. 5,216,079, the addition of 20% low density polyethylene (USI Microthene MN-703-6) to CELCON M90 results in a decrease in coefficient of friction and improved wear resistance as compared to oxymethylene copolymer lubricated with 20% PTFE (LNP TL-140). Other lubricants such as molybdenum disulfide, graphite power, silicone fluid, etc. may also be part of the lubricant system and replace some or all of the PTFE. For example, LUBRILOY KL (product code 741-170-200) sold by LNP Engineering Plastics, Inc. has a CELCON M270 matrix with a lubricant system that eliminates the PTFE but which has a wear resistance and coefficient of friction (0.03 static, LNP#3) that is better than CELCON M270 lubricated with PTFE. In addition, the materials used in the LNP's lubricant system are less expensive than PTFE.

LUBRILOY KL acetal copolymer is provided as pellets from which slide 10 can be injection molded using conventional ram or reciprocating screw injection molding machines. If a mirror finish is desired, the mold can be polished to a very smooth finish and then chrome plated. In addition to enhancing the physical appearance of slide 10, the mirror finish also lowers the coefficient of friction.

As shown in FIG. 1, non-slip resilient pad 20 is seated in recess 18 and adhered to upper face 12. A tear resistant fabric 32 may be applied to pad 20. Pad 20 projects above rim 22 and is formed of a compressible material. Pad 20 may project from about 0.05 to 0.25 inches above rim 22, preferably from 0.05 to 0.15 inches and most preferably about 0.07 inches. Compressible material is preferably softer than latex rubber or ethylvinylacetate (EVA) which are used on slides made under the '699 patent and may be a cellular urethane foam. A material sold as HyPUR-cel-T-0812 by Rubberlite Inc. with a density 104–152 g/$cm^3$ has been found satisfactory for pad 20. The leg or base of the object being moved settles into pad 20 which is softer than EVA so that the object does not tend to come off the slide. In the event that the object does shift, the leg or base tends to be stopped by rim 22.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A moldable slide for use in moving heavy pieces of furniture or other heavy objects across a floor, said slide comprising an upwardly cupped plate formed of an acetal copolymer matrix into which a lubricant is incorporated and having a coefficient of friction of less than 0.2 and a non-slip pad formed of synthetic plastic material, said slide having an upper and a lower face with a recess in the upper face into which the pad is at least partially received, said slide having an upstanding rim about a periphery of the recess and said lower face rising above the floor when the slide is partially inserted beneath a floor contacting portion of the furniture or object.

2. The slide of claim 1 wherein the acetal copolymer matrix is lubricated with a lubricant system including at least in part polytetrafluoroethylene.

3. A moldable slide for use in moving heavy pieces of furniture or other heavy objects across a floor, said slide comprising an upwardly cupped substantially circular plate formed of an acetal copolymer matrix into which a lubricant is incorporated and having a coefficient of friction of less than 0.2 and a non-slip pad formed of synthetic plastic material, said slide having an upper and a lower face with a recess in the upper face into which the pad is at least partially received, said slide having a diameter about six inches with an upstanding rim about a periphery of the recess and said lower face rising above the floor at least about 1 inch when the slide is partially inserted beneath a floor contacting portion of the furniture or object.

4. The slide of claim 3 wherein the acetal copolymer matrix is lubricated with a lubricant system including at least in part polytetrafluoroethylene.

5. A moldable slide with a mirror finish for use in moving heavy pieces of furniture or other heavy objects across a floor, said slide comprising an upwardly cupped substantially circular plate formed of an oxymethylene acetal copolymer matrix into which a lubricant is incorporated and having a coefficient of friction of less than 0.2 and a non-slip pad formed of cellular urethane foam, said slide having an upper and a lower face with a recess in the upper face into which the pad is at least partially received, said slide having a diameter about six inches with an upstanding rim about a periphery of the recess and said lower face rising above the floor at least about 1 inch when the slide is partially inserted beneath a floor contacting portion of the furniture or object.

6. The slide of claim 5 wherein the plate has a thickness about 0.09 inches.

7. The slide of claim 6 wherein the rim has a height of about 0.25 inches.

8. The slide of claim 7 wherein the recess is about 0.15 inches and the pad is about 0.22 inches thick.

9. The slide of claim 8 wherein the rim is about 0.40 inches wide.

10. The slide of claim 5 wherein the acetal copolymer matrix has recurring methylene groups interspersed with oxy(higher)alkylene groups.

* * * * *